US005150909A

United States Patent [19]

Fitzwater

[11] Patent Number: 5,150,909

[45] Date of Patent: Sep. 29, 1992

[54] AIR GUN PELLET DESIGN

[76] Inventor: Edwin Fitzwater, 1370 Bryant St., Rahway, N.J. 07065

[21] Appl. No.: 680,432

[22] Filed: Apr. 4, 1991

[51] Int. Cl.[5] ..... F42B 6/10; F42B 14/08

[52] U.S. Cl. ..... 273/428; 102/522

[58] Field of Search ..... 273/428; 102/520-522

[56] References Cited

U.S. PATENT DOCUMENTS

| | | | |
|---|---|---|---|
| 3,400,661 | 9/1968 | Coon et al. | 102/522 |
| 4,175,493 | 11/1979 | Daily | 102/520 |
| 4,947,752 | 8/1990 | Richert | 102/522 X |

FOREIGN PATENT DOCUMENTS

| | | | |
|---|---|---|---|
| 2179427 | 3/1987 | United Kingdom | 102/520 |

*Primary Examiner*—Paul E. Shapiro
*Attorney, Agent, or Firm*—John F. Ohlandt

[57] ABSTRACT

A gun pellet comprising a projectile removably retained on a skirt assembly, wherein the skirt assembly provides an arrangement for separating the projectile from the skirt assembly after the initial firing of the gun but before the projectile exits the barrel of the gun. In one version, the skirt assembly has a skirt body, with a shaft affixed to the skirt body; a projectile clutch assembly includes a clutch body, at least two clutch jaws disposed about the projectile; a retainer device is disposed within the clutch body such that the projectile is retained within the clutch jaws; and a conduit is disposed in the clutch body such that the shaft is capable of traversing through the conduit and propelling the projectile from the clutch jaws.

8 Claims, 3 Drawing Sheets

AIR GUN PELLET DESIGN

The present invention relates to a gun pellet comprising a projectile of a hard material suitable for the purpose, and a skirt assembly of a softer material to efficiently convert the instantaneous high pressure of a gas into a high enough force to provide a rapid acceleration of the pellet in the gun barrel, which is necessary to produce separation of the projectile from the skirt assembly during its movement through the gun barrel. After separation the skirt assembly remains capable of guiding and pushing the projectile out the end of the gun barrel.

BACKGROUND OF THE INVENTION

Pellets designed for use in air, gas or spring guns are typically made of either a simple projectile, e.g., a skirted lead pellet or a combination of a hard material projectile and a softer skirt portion attached thereto. In the case of skirted lead pellets, the material is soft enough not to damage the bore surface of the gun barrel; however, the skirts of these lead pellets are easily damaged and deformed out of shape prior to use, rendering them difficult to use or seriously impairing their accuracy in use.

Accordingly, combination pellets were intensively developed because they turn out to be more durable with respect to handling. These combination pellets were also developed to provide a low coefficient of friction and hence greater efficiency in use.

One example of a combination pellet is set forth in U.S. Pat. No. 4,251,079 (Earl et al.), which issued on Feb. 17, 1981. The pellet disclosed in Earl et al. comprises a head or projectile portion adapted to provide weight for the pellet for stability during flight and penetration when striking a target; and a skirt portion made of a different material which is essentially free of any metal filler and being proportioned with at least two portions which are larger in diameter than the head portion such that the skirt portion guides the pellet through the gun barrel. The skirt portion is made from plastic material having a low coefficient of friction and sufficient elasticity to regain its shape after deformation, such as polytetrafluorocarbon.

It will be understood that, since the head or projectile portion described in 4,251,079 has a smaller diameter than the skirt portion, the head portion does not contact the gun bore surface during passage of the pellet therealong. Moreover, the pellet of U.S. Pat. No. 4,251,079 has its skirt portion and head portion firmly secured together to prevent separation whereby the head portion will provide the necessary stabilizing weight in flight.

Unfortunately, it has been discovered that the fixedly secured skirt body can also affect the accuracy of the pellet once it exits the gun barrel.

The unique two-piece pellet design according to the present invention overcomes the lack of accuracy of conventionally skirted pellets.

Thus, one object of the present invention is that the projectile be removably retained by a novel skirt assembly for the purpose of handling the pellet and inserting same into the bore of a gun. Upon shooting the gun, the instantaneous injection of a gas under high pressure will create such rapid acceleration of the pellet as to cause the projectile to disengage, while still within the gun barrel, from the holding retention the skirt assembly exerts on the projectile, the skirt assembly then guiding and pushing the projectile out the end of the barrel.

Upon leaving the gun barrel, the projectile is free to travel by itself and the skirt assembly simply falls away due to air resistance, the skirt assembly having a mass about half that of the projectile. The projectile in flight will be unhindered, which is a substantial improvement over the conventional skirted pellets which retain the skirt portion during all or part of their flight after exiting the gun barrel.

The present invention also provides many additional advantages which shall become apparent as described below.

SUMMARY OF THE INVENTION

A gun pellet comprising a projectile removably retained by a skirt assembly, in which the skirt assembly includes means for separating the projectile from the skirt assembly after the initial firing of the gun, responsive to the force developed within the gun barrel, and before the projectile exits the gun barrel.

The skirt assembly according to one embodiment of the present invention comprises: a skirt body; a shaft affixed to the skirt body; and a projectile clutch assembly comprising a clutch body, at least two clutch jaws disposed about the projectile such that the projectile is removably retained within the clutch jaws, a retainer means disposed at the inner end of the clutch body and detachably connected thereto, and a conduit disposed in the clutch body such that the shaft is capable of traversing through the conduit and propelling the projectile from the clutch jaws.

According to another embodiment of the present invention, the skirt assembly may optionally comprise: a skirt body; and at least two skirt blades movably disposed about the skirt body and affixed to the projectile such that the skirt blades release the projectile upon the firing of the pellet. The skirt blades are affixed to the projectile by thermal welding, ultrasonic welding, chemical adhesion, or any other known means. As an alternate to discrete skirt blades, a segmented collar could likewise be movably disposed about the skirt body.

Other and further objects, advantages, and features of the present invention will be understood by reference to the following specification in conjunction with the annexed drawings, wherein like parts have been given like numbers.

DESCRIPTION OF THE PREFERRED EMBODIMENTS

Figure 1:
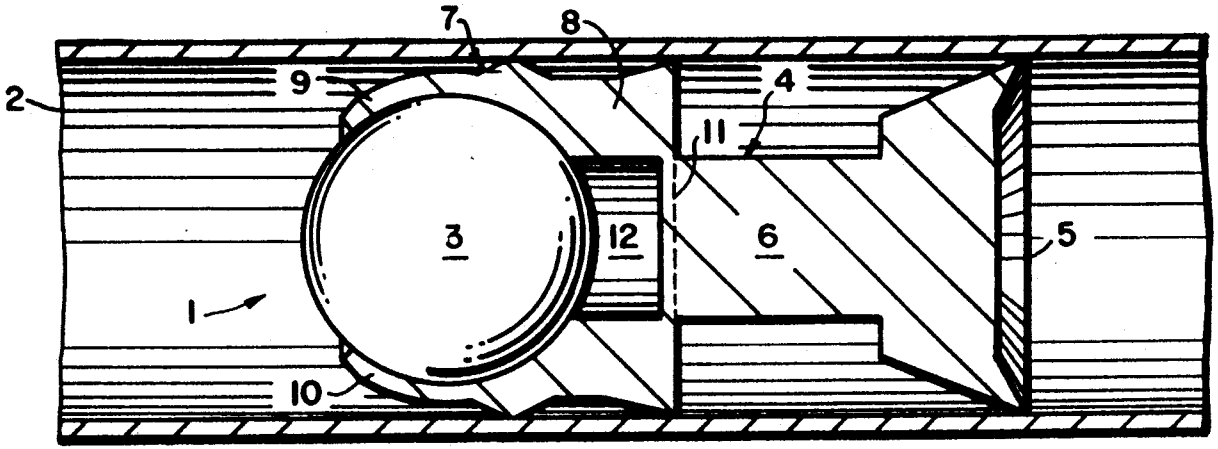
FIG. 1 is a schematic representation of a shear ring-clutch pellet contained within a gun barrel in accordance with the present invention.

The gun pellets constructed in accordance with the concept of the present invention are particularly useful in air or gas powered guns, although it is conceivable that these pellets can be used in other types of gun, such as spring powered guns. These gun pellets can best be understood by referring to the attached drawings, in which the first embodiment, depicted in FIGS. 1-4, comprises a shear-ring clutch gun pellet 1 disposed within a gun barrel 2. Gun pellet 1 comprises a projectile 3 removably retained by a shirt assembly 4. Skirt assembly 4 includes a means for separating projectile 3 from skirt assembly 4 after the initial firing of the gun, but before the projectile exits barrel 2 of the gun.

In implementing the arrangement or means for appropriately separating the projectile 3 from the skirt assembly 4, the skirt assembly is constructed as seen in FIGS. 1-4 to include: a skirt body 5; a shaft 6 affixed to the skirt body; and a projectile clutch assembly 7 comprising a clutch body 8, and at least two clutch jaws 9 and 10 disposed about projectile 3 such that projectile 3 is retained within clutch jaws 9 and 10. Additionall, the illustrated retainer means 11 is integrally formed between the skirt shaft 6 and the clutch body 8. A conduit 12 is disposed in the clutch body such that shaft 6 is capable of shearing through the retainer means, traversing through conduit 12, and propelling projectile 3 from clutch jaws 9 and 10.

Figure 2:
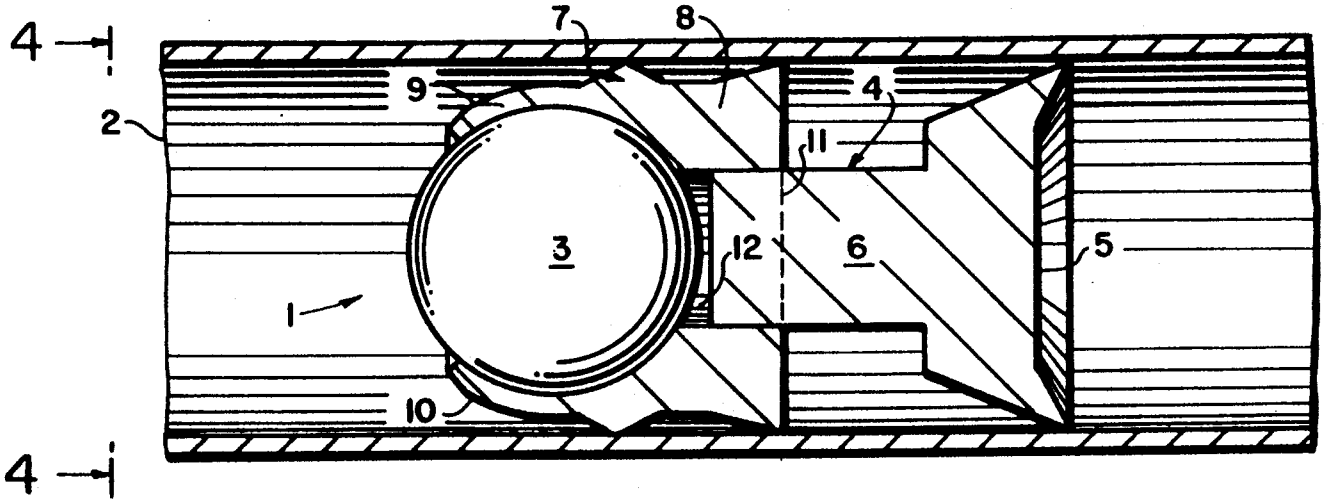
FIG. 2 is a schematic representation of the shear ring-clutch pellet of FIG. 1 wherein the shear ring has been sheared by the initial inertia of the projectile resisting the forward movement of the skirt assembly.
Figure 3:
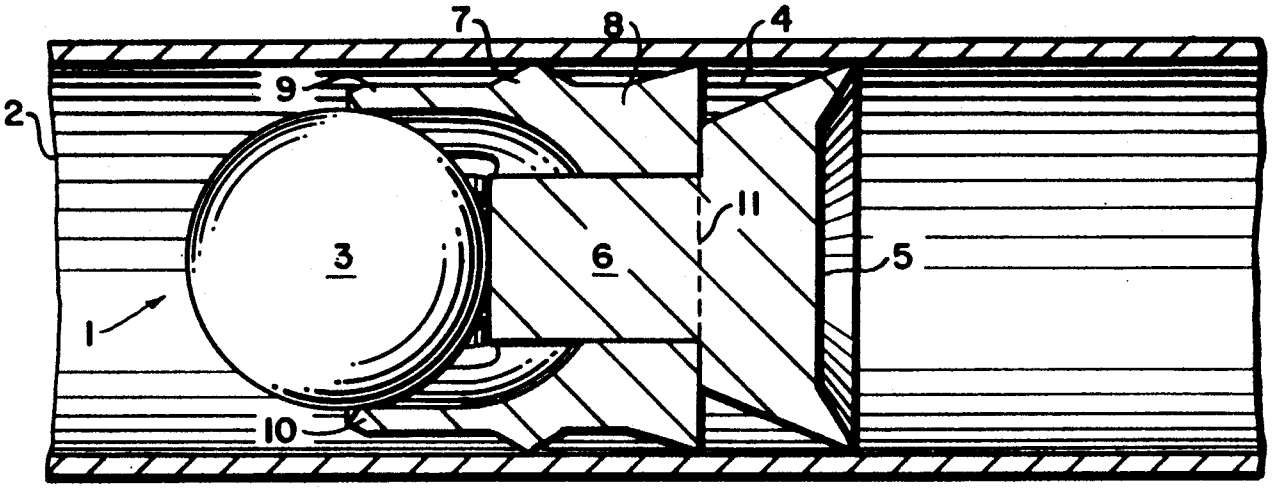
FIG. 3 is a schematic representation of the shear ring-clutch pellet of FIG. 1 wherein the projectile is being propelled out of the clutch jaws due to the force exerted thereupon by the forward movement of the skirt shaft.

Retainer means 11 is preferably a shear or thin ring. This shear or thin ring is formed of any suitable material, such as a thermoplastic material, which easily breaks due to the initial inertia of projectile 3. As shown in FIG. 2, upon a pressure, such as air or gas, being applied to skirt assembly 4, shaft 6 shears and slides through conduit 12 and eventually contacts projectile 3, propelling it from clutch jaws 9 and 10. This is shown in FIG. 3 attached hereto.

Projectile 3 is, for example, any metal or metal alloy, although any other known suitable material may also be used. The one-piece molded skirt assembly 4 is typically formed of a thermoplastic material or any other known material with similar properties. The thermoplastic material may be at least one compound selected from the group consisting of polytetrafluorocarbon, nylon, polyethylene, polypropylene, and cellulose acetate.

Figure 4:
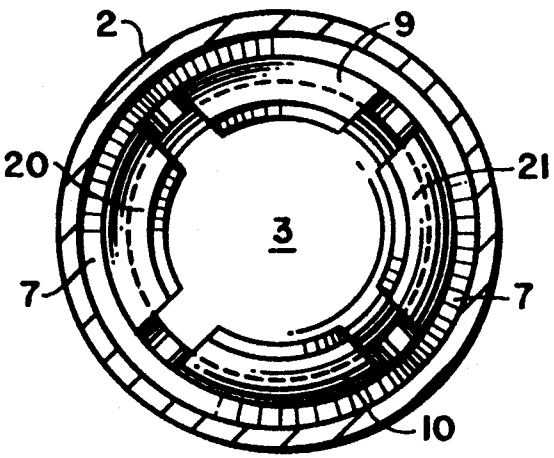
FIG. 4 is a schematic representation of a front view of the clutch of FIG. 1.

FIG. 4 demonstrates how projectile 3 is retained by clutch jaws 9, 10, 20, and 21.

Consider now the actions involved when the gun is being operated. Firstly, the one-piece skirt assembly 4 with projectile 3 positioned within the clutch jaws is inserted into gun barrel 2. Secondly, when the gun is fired, the instantaneous high gas pressure is injected behind skirt assembly 4; as a consequence, the resultant force causes the skirt body 5 to move forward, and being resisted by the initial inertia of the projectile 3, causes the retainer means 11 to separate the skirt body 5 form clutch body 8. Thirdly, skirt body 5 and shaft 6 continue moving towards projectile 3 (FIG. 2) until contact is made. Then, projectile 3 is propelled forward as shown in FIG. 3. Clutch body 8 now slides back due to friction exerted on its perimeter by the bore walls and the pressure of the air being pushed out of barrel 2 in front of projectile 3. As clutch body 8 slides back, the skirt shaft 6 pushes projectile 3 out of the retention of the clutch jaws. Immediately upon exiting barrel 2, projectile 3 will pop free of the clutch jaws and skirt assembly 4 will fall away.

Figure 7:
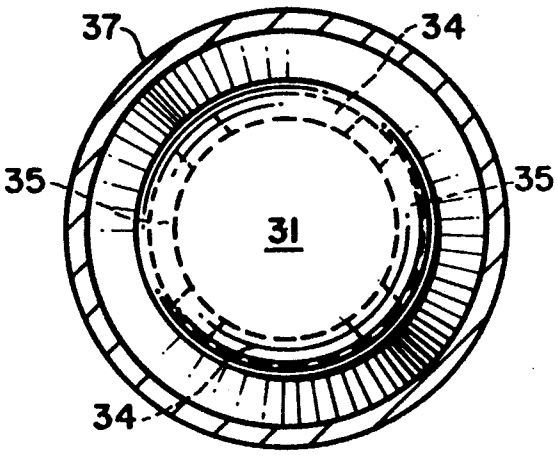
FIG. 7 is a schematic representation of a front view of the blades of the welded blade pellet device of FIG. 5.
Figure 5:
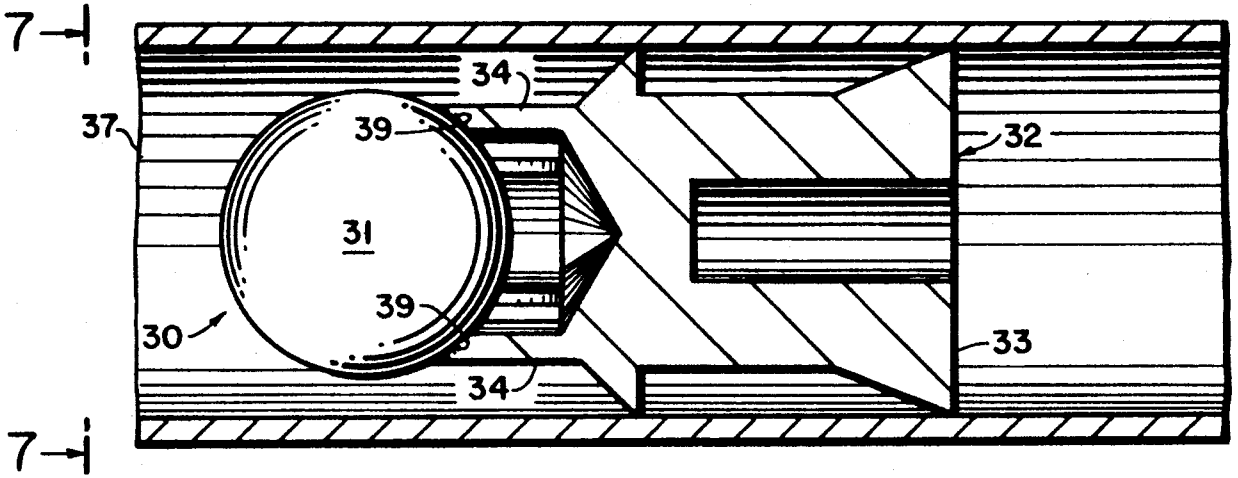
FIG. 5 is a schematic representation of the welded blade pellet embodiment according to the present invention.
Figure 6:
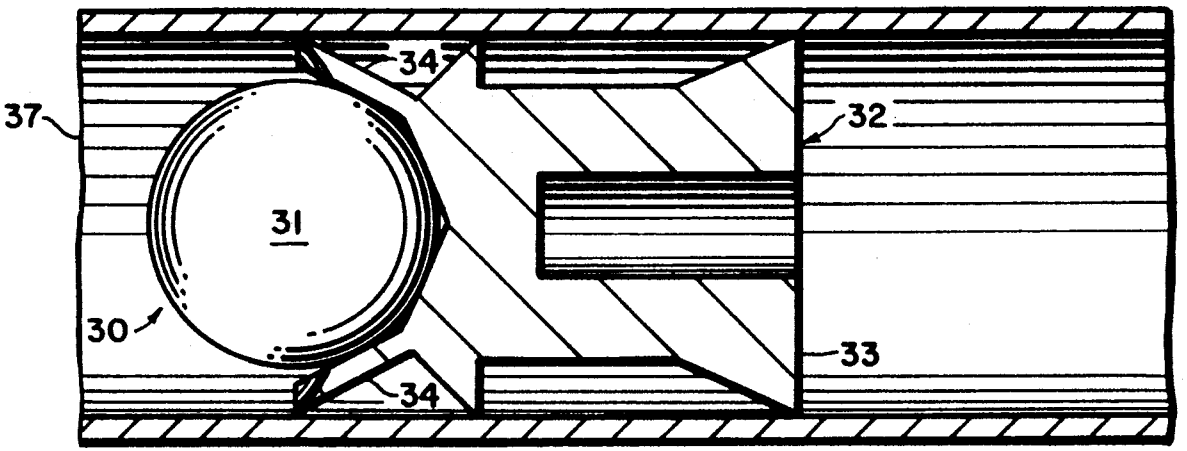
FIG. 6 is a schematic representation of the welded blade pellet design of FIG. 5 wherein the forward movement of the skirt assembly causes the weld or adhesion points between the blades and the projectile to be sheared.

According to another embodiment of the present invention shown in FIGS. 5-7, a pellet 30 comprises, as before, a projectile 31 and a skirt assembly 32. The latter includes a skirt body 33; and at least two skirt blades 34 and 35 movably disposed about skirt body 33 and affixed to projectile 31 such that skirt blades 34 and 35 release projectile 31 upon the firing of the gun. The skirt blades may be affixed to the porjectile by thermal welding, ultrasonic welding, chemical adhesion, or any other known means.

The key to the welded blade pellet design demonstrated in FIGS. 5-7 is the thermal welding of projectile 31 to at least two skirt blades 34 and 35 disposed on the forward end of skirt body 33 in such a way that projectile 31 is removably attached to skirt body 33 by simply heating the projectile to a suitable temperature and then holding the skirt blades against it at adhesion points 39, achieving the desired melt-weld. This thermal welding is not a limitation, however, since the affixing can be achieved by any suitable adhesive applied to the blade ends, or by any other means.

The welds or attachments are located on approximately a 45 degree angled face of projectile 31 so that, when the skirt assembly is subjected to the gas pressure within the gun and starts to move, the initial inertia of projectile 31 will cause the weld or adhesion points 39 to be sheared free, with skirt blades 34 and 35 then bending outward to cradle and guide projectile 31 through barrel 37, as shown in FIG. 6. Now this pellet 30 comprises two loose pieces, i.e., skirt assembly 32 cradling projectile 31 disposed directly ahead of it, exits barrel 37 and immediately projectile 31 flies free of skirt assembly 32 which is quickly dragged down by air resistance.

The amount of force required to shear the shear ring in the embodiment depicted in FIGS. 1-4, or break the weld or adhesion points 39 in the embodiment of FIGS. 5-7, depends on the materials involved (e.g., polypropylene and cellulose acetate would require less force than nylon), the mass of the projectile and the gas pressures in the gun.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A gun pellet for use in a gun having a standard barrel of uniform diameter comprising:

a projectile and a skirt assembly;

said skirt assembly including means for removably retaining said projectile, and means for causing said projectile to disengage from the retention by said skirt assembly responsive to the force, and the consequence acceleration, developed within the standard gun barrel upon firing of the gun, such that disengagement of the projectile from the skirt assembly occurs before said projectile exits the open end of said standard gun barrel;

said skirt assembly further comprising:

a skirt body;

a shaft affixed to said skirt body; and a projectile clutch assembly comprising a clutch body, at least two clutch jaws disposed about said projectile such that the projectile is removably retained within said clutch jaws, a retainer means disposed within said clutch body and detachably connected thereto, and a conduit disposed in said clutch body such that said shaft is capable of traversing through said conduit and propelling said projectile from said clutch jaws.

2. The gun pellet according to claim 1, wherein said retainer means is a shear ring.

3. The gun pellet according to claim 2, wherein said skirt shaft is secured to said clutch assembly by said retainer means.

4. A gun pellet for use in a gun having a standard barrel of uniform diameter comprising:

a projectile and a skirt assembly;

said skirt assembly including means for removably retaining said projectile, and means for causing said projectile to disengage from the retention by said skirt assembly responsive to the force, and the consequence acceleration, developed within the standard gun barrel upon firing of the gun, such that disengagement of the projectile from the skirt assembly occurs before said projectile exits the open end of said standard gun barrel;

said skirt assembly further comprising:

a skirt body; and at least two skirt blades movably disposed about said skirt body and affixed to said projectile such that said skirt blades release said projectile upon the firing of said pellet.

5. The gun pellet according to claim 4, wherein said skirt blades are affixed to said projectile by thermal welding.

6. The gun pellet according to claim 4, wherein said skirt blades are affixed to said projectile by ultrasonic welding.

7. The gun pellet according to claim 4, wherein said skirt blades are affixed to said projectile by means of an adhesive.

8. The gun pellet according to claim 4, wherein said skirt blades are affixed to said projectile displaced at approximately 45 degree angle around the pellet center line.

* * * * *